United States Patent [19]

Alley et al.

[11] 4,211,957

[45] Jul. 8, 1980

[54] AMORPHOUS METAL LAMP BALLAST HAVING A CAPACITOR INTEGRAL WITH THE MAGNETIC CORE

[75] Inventors: Robert P. Alley, Manlius; Theodore R. Haller, Schenectady; Russell E. Tompkins, Scotia, all of N.Y.

[73] Assignee: General Electric Company, Schenectady, N.Y.

[21] Appl. No.: 7,918

[22] Filed: Jan. 31, 1979

[51] Int. Cl.[2] ..... H05B 41/16

[52] U.S. Cl. ..... 315/276; 315/239; 315/244; 315/247; 336/105; 336/213; 361/270

[58] Field of Search ..... 315/239, 243, 244, 247, 315/276; 336/105, 213, 219, 233, 234; 361/270

[56] References Cited

U.S. PATENT DOCUMENTS

| | | | |
|---|---|---|---|
| 2,521,513 | 9/1950 | Gray | 315/243 |
| 2,962,679 | 11/1960 | Stratton | 336/83 |
| 3,188,505 | 6/1965 | Wiley | 310/259 |
| 3,215,910 | 11/1965 | Schilling | 361/275 X |
| 4,116,728 | 9/1978 | Becker et al. | 336/213 X |
| 4,127,891 | 11/1978 | Rayburn | 361/309 |

OTHER PUBLICATIONS

Reeves, *Choke-Capacitor Hybrid as a Fluorescent Lamp Ballast,* Proc. IEE, vol. 122, No. 10, Oct. 1975, pp. 1151-1152.

Gray et al., *Principles and Practices of Electrical Engineering,* McGraw-Hill, 1947, p. 300.

*Primary Examiner*—Eugene R. La Roche

*Attorney, Agent, or Firm*—Donald R. Campbell; James C. Davis; Marvin Snyder

[57] ABSTRACT

The magnetic core of a lamp ballast is bifilar wound from inherently thin amorphous metal strip and utilizes the laminations of the magnetic circuit as the plates of a capacitor. The outer yoke of the core encases the coils and is edge-wound from amorphous metal ribbon alternated with insulation to also be the power factor capacitor. The inner core is accordion-pleated or spirally wound and is electrically connected to be the starting capacitor. Cutaways in the inner core cause saturation and shape the lamp current waveform.

14 Claims, 12 Drawing Figures

Fig. 6
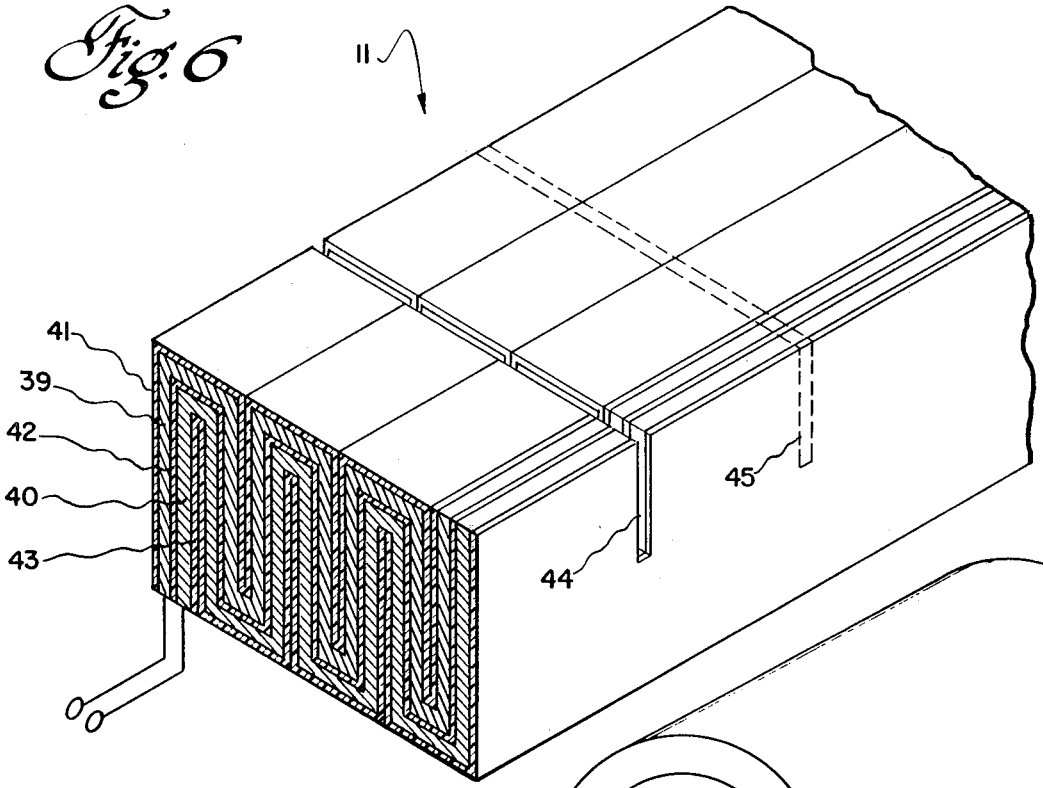
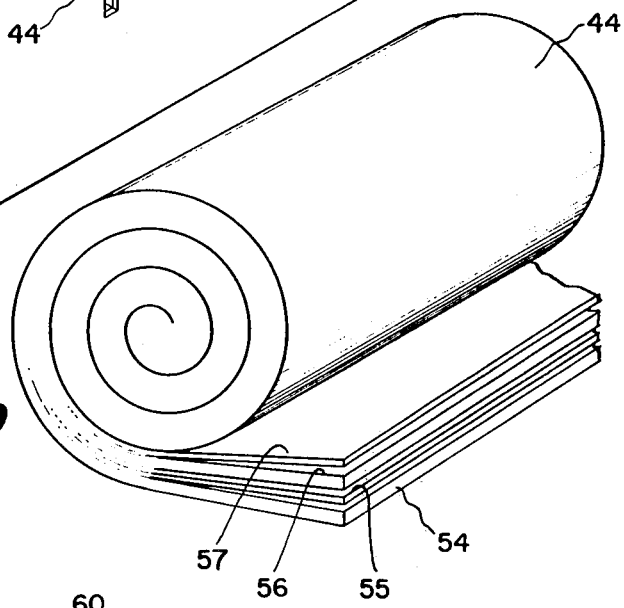
Fig. 9
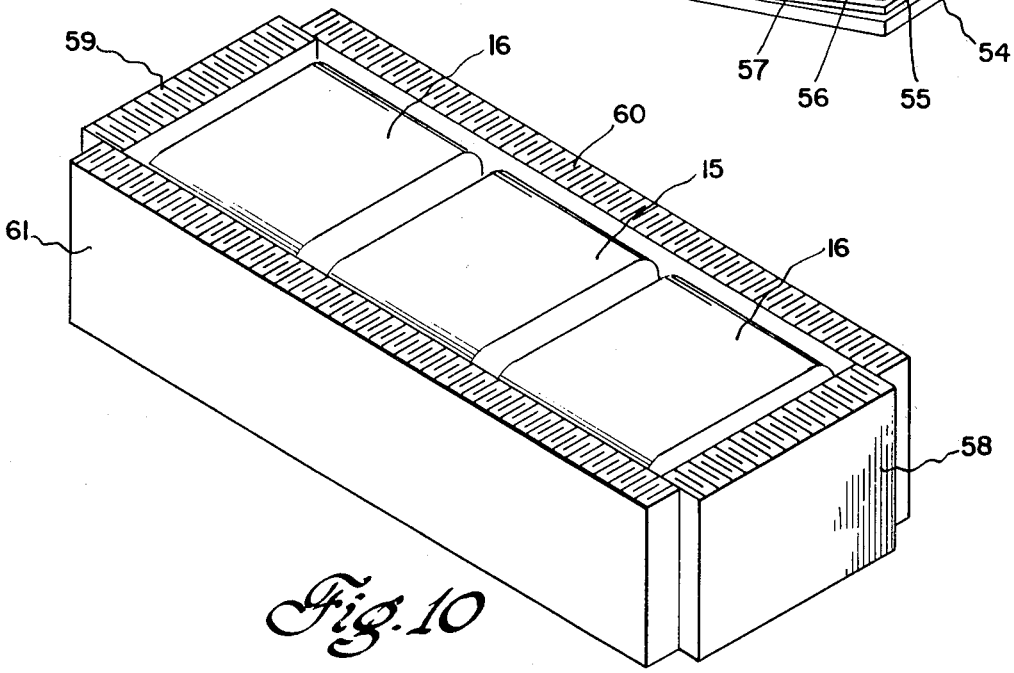
Fig. 10

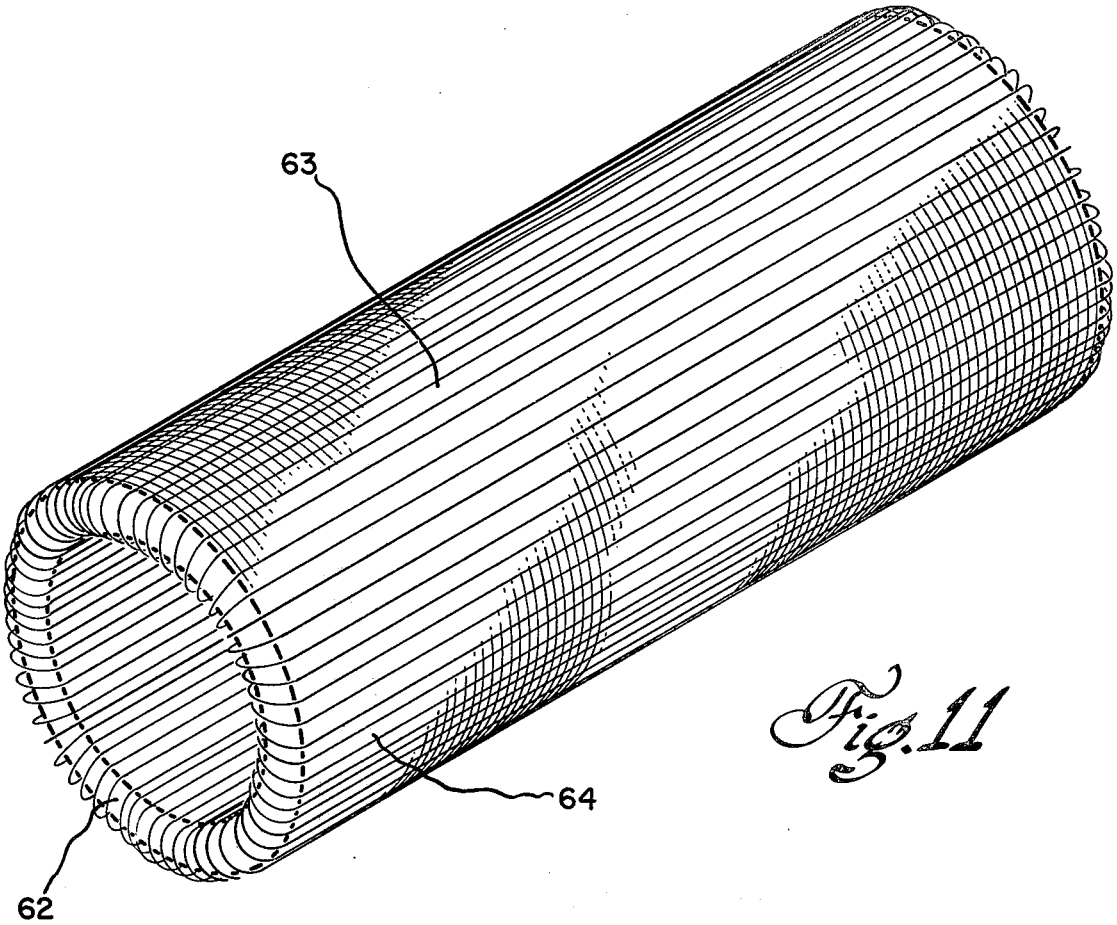
Fig. 11
Fig. 12
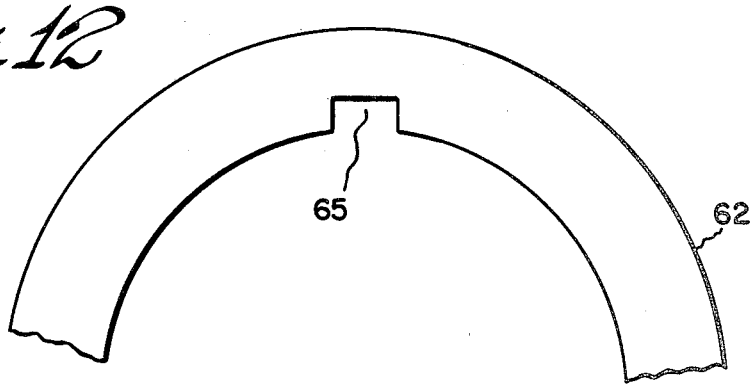

AMORPHOUS METAL LAMP BALLAST HAVING A CAPACITOR INTEGRAL WITH THE MAGNETIC CORE

BACKGROUND OF THE INVENTION

This invention relates to magnetic lamp ballasts and especially to improved ballasts having an amorphous metal core structure which has a dual function as a capacitor.

Fluorescent and mercury vapor lamps require special circuitry for their starting and running when excited from an alternating current supply. These lamps have a negative resistance characteristic which must be compensated by ballasting impedance, and the ballast supplies a higher peaked voltage for starting and a regulated square wave current for running. It is desirable that the current through the lamp be flat-topped to increase the life of the lamp. A high reactance transformer is needed to meet the requirements of a good ballast, and a capacitor is added to the ballast circuit for starting and power factor correction. A typical ballast for two fluorescent lamps (see FIG. 2) has a relatively small starting capacitor and a large power factor capacitor, both discrete components separate from the high reactance transformer. Present magnetic ballasts are made from steel lamination punchings and include mangetic shunts and cutaways to cause core saturation. The present configurations substitute cores made from amorphous metal ribbon for the lamination punchings.

Amorphous metal is also known as metallic glass and is made from metallic alloys that can be quenched rapidly without crystallization. The material is fabricated on a rotating chill cylinder in the form of a long ribbon with a thickness of 2 mils or less; the thickness limitation is set by the rate of heat transfer through the already solidified material which must be rapid enough that the last increment of material to solidify still avoids crystallization. This is several times thinner than currently used lamination materials. Despite this possible limitation, at power frequencies amorphous metal core material is attractive because of the combination of potential low cost and low magnetic losses; the core loss is about one-fourth the loss found in silicon sheet steel.

It has been recognized that the thinness of amorphous metal ribbon can be capitalized upon by utilizing the stator or rotor core laminations as plates of a start/run capacitor in a single phase electric motor. This integral construction is made possible by the tremendously increased interlamination area with the thinner material, and is described in allowed application Ser. No. 914,444 filed on June 12, 1978, T. H. Haller, "Amorphous Metal Electric Motor with Integral Capacitor". Amorphous metal "0" core ballasts and reactors having magnetic structures made of ribbon without interlaminar insulation are disclosed in application Ser. No. 966,855, R. P. Alley and R. E. Tompkins, filed on Dec. 6, 1978. Both are assigned to the instant assignee.

SUMMARY OF THE INVENTION

Magnetic lamp ballasts use amorphous metal ribbon in several different ways and include a capacitor as part of the core assembly to realize potentially lower cost and higher power efficiency ballasts. The laminated magnetic core of several ballast configurations with an integral capacitor is comprised of bifilar or two-in-hand wound magnetic amorphous metal strip and alternating insulation layers which are electrically connected in circuit relationship with a coil to be a power factor capacitor or, in some configurations, a power factor capacitor and a starting capacitor. The magnetic alloy of this inherently thin (about 1.5–2 mils) material preferred for this application has a $B_r/B_s$ ratio exceeding 80 percent, i.e., it has a square hysteresis loop; one such alloy is $Fe_{82}B_{15}Si_3$.

The principal embodiment has a rectangular geometry and has an inner core on which the primary and secondary coils are assembled, end yokes made of cast compressed amorphous metal flake, and an outer yoke which also serves as a case and is comprised of multiple turns of a pair of edge-mounted parallel amorphous metal strips separated by alternating insulation layers, the secondary coil being electrically connected in series with the pair of strips separated by insulation which function as a power factor capacitor. The inner core can be comprised of accordion-pleated folds of a second pair of parallel amorphous metal strip and alternated insulation which are electrically connected to be a starting capacitor in series with the power factor capacitor. Grooves are cut in the inner core to cause core saturation and shape the lamp current waveform. A modification has a round geometry; the outer yoke is helically wound and the inner core is spirally wound two-in-hand.

Another embodiment of the ballast assembly has planar end yokes and outer yokes in a four-walled structure, all made of bifilar amorphous metal strips and dielectric that are wound into accordion pleats and connected to be the power factor capacitor. The accordion-pleated inner core is the same as just described. A ballast with a combined toroidal core and power factor capacitor is helically wound and has cutaways under the secondary coil to secure the proper flux nonlinearities. The dual use of magnetic core components results in cost, weight, and space savings.

BRIEF DESCRIPTION OF THE DRAWINGS

FIG. 6 is a perspective of the accordion-pleated inner core in FIG. 1 which also serves as a starting capacitor;

FIG. 9 is a perspective of the inner core and integral capacitor in FIG. 7;

FIG. 10 shows an embodiment of the ballast similar to FIG. 1 but with a rectangular outer yoke or case made of accordion-pleated sections;

FIG. 11 is a perspective of another embodiment with a toroidal core and integral capacitor and distributed primary and secondary coils; and FIG. 12 is a cross-section of the core in FIG. 11 with a slot to cause saturation.

DESCRIPTION OF THE PREFERRED EMBODIMENTS

Figure 1:
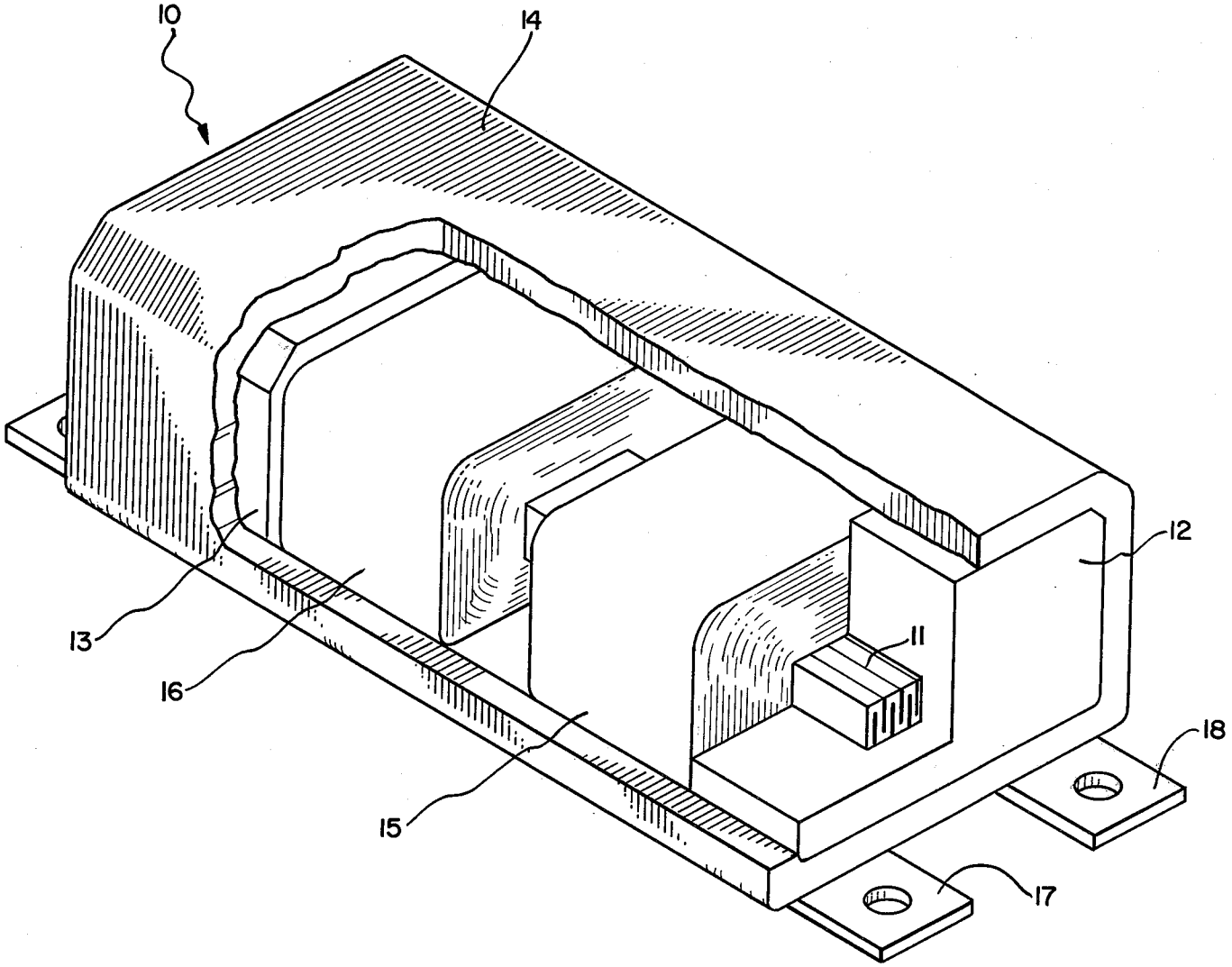
FIG. 1 is a perspective view with portions broken away to reveal interior detail of the preferred embodiment of lamp ballast incorporating power factor and starting capacitors in the magnetic structure.

The lamp ballast assembly in FIG. 1 substitutes a wound amorphous metal core for the stacks of steel laminations in conventional ballasts. The added resistivity of the amorphous metal (about four times that of silicon steel) increases the magnetic flux leakage of the core assembly so that magnetic shunts are not necessary, thereby saving material and assembly cost. Restrictions to reduce the core cross section and cause core saturation are brought about by aluminum oxide grinding cuts. The large power factor correction capacitor and smaller starting capacitor are made up in the core of the ballast assembly.

The preferred embodiment of the invention in FIG. 1 has a rectangular geometry and is comparable in overall size to present ballasts for two 40-watt fluorescent lamps which require separate power factor and starting capacitors. The magnetic core indicated generally at 10 provides a closed magnetic circuit and is comprised of an inner core 11 made of amorphous metal strip and which is specially constructed to also be a dry starting capacitor, a pair of end yokes or end members 12 and 13 made of cast amorphous magnetic material, and an outer yoke 14 made of amorphous metal strip which doubles as the ballast case and is further specially configured to also be a dry power factor capacitor. Primary coil 15 and secondary coil 16 are assembled on the inner core such that the former has a tight magnetic coupling and the latter a loose magnetic coupling, and both are encased by the outer yoke. Inner core 11 is made of bifilar or two-in-hand amorphous strips that are wound in accordion pleats with at least one side of every strip coated with a suitable material having a dielectric constant compatible with the capacitance needed. End yokes 12 and 13 are compressed amorphous metal flake in a binder which is cast directly on the ends of the inner core. Outer yoke 14 has multiple turns of bifilar wound amorphous metal strip which are coated with appropriate dielectric material to realize the desired capacitance. Although not shown, the exterior of the case may be covered with insulation for safety purposes. Base plates 17 and 18 are glued to one side of the case to facilitate installation.

Figure 2:
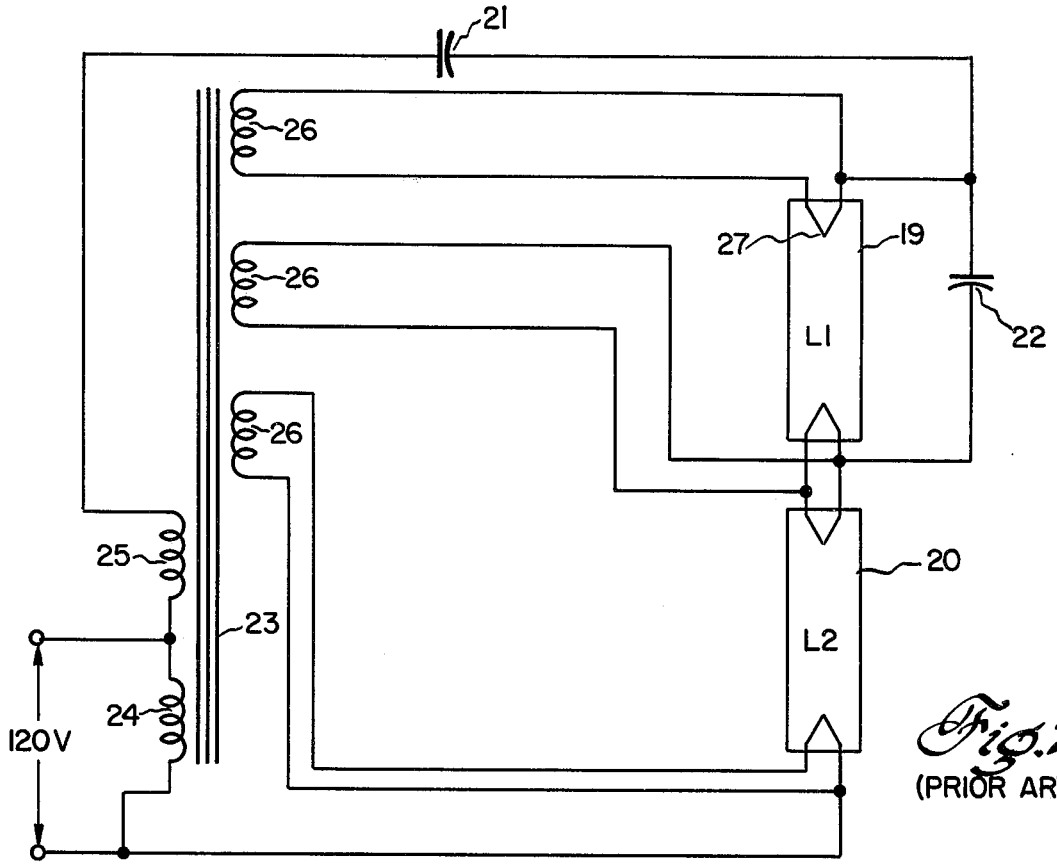
Fig. 2 (PRIOR ART)
FIG. 2 is a circuit diagram of a typical ballast for two fluorescent lamps.

FIG. 2 is a schematic circuit diagram of a typical ballast for two 40-watt fluorescent lamps 19 and 20, and the equipment in FIG. 1 includes all of the illustrated transformer components as well as power factor capacitor 21 (about 4 microfarads) and starting capacitor 22 (about 0.05 microfarads). The various windings on common core 23 are primary and secondary windings 24 and 25 and three filament windings 26 which are connected across lamp electrodes 27. The filament windings 26 have only a few turns and may be included in either the primary coil package or the secondary coil package. Power factor and starting capacitors 21 and 22 are in series with one another and with secondary winding 25, and starting capacitor 22 is placed across the electrodes of one of the lamps such as lamp 19. A 120 volt ac voltage is impressed across the primary coil and by autotransformer action the voltage available for starting across the windings is 280 volts. Initially, lamps 19 and 20 are off and appear as an open circuit, and the reactance of starting capacitor 22 is small such that about 280 volts is impressed across lamp 20 and this is sufficient to turn it on. The voltage drop across the turned on lamp decreases to about 100 volts and the remaining voltage is now impressed across lamp 19 and is sufficient to turn it on.

Construction of the magnetic core to also be a dry capacitor permits utilization of the core material which is required for the magnetic circuit to serve also as the plate material of an integral capacitor, resulting in cost, weight, and space savings. One of the previously assumed disadvantages of using amorphous metal alloys in transformers and motors has been the large number of laminations that have been required due to the inherently thin nature of this material. In spite of the thickness limitation, a number of ways are known for handling the material and once assembled such a core has a significant interlaminar area. The capacitance of a capacitor is directly proportional to the area of the plates and to the dielectric constant of the insulator between the plates, and is inversely proportional to the distance between plates. The plate area is many times greater where the core laminations are made of very thin amorphous metal strip rather than much thicker punched steel strip material.

Figure 3:
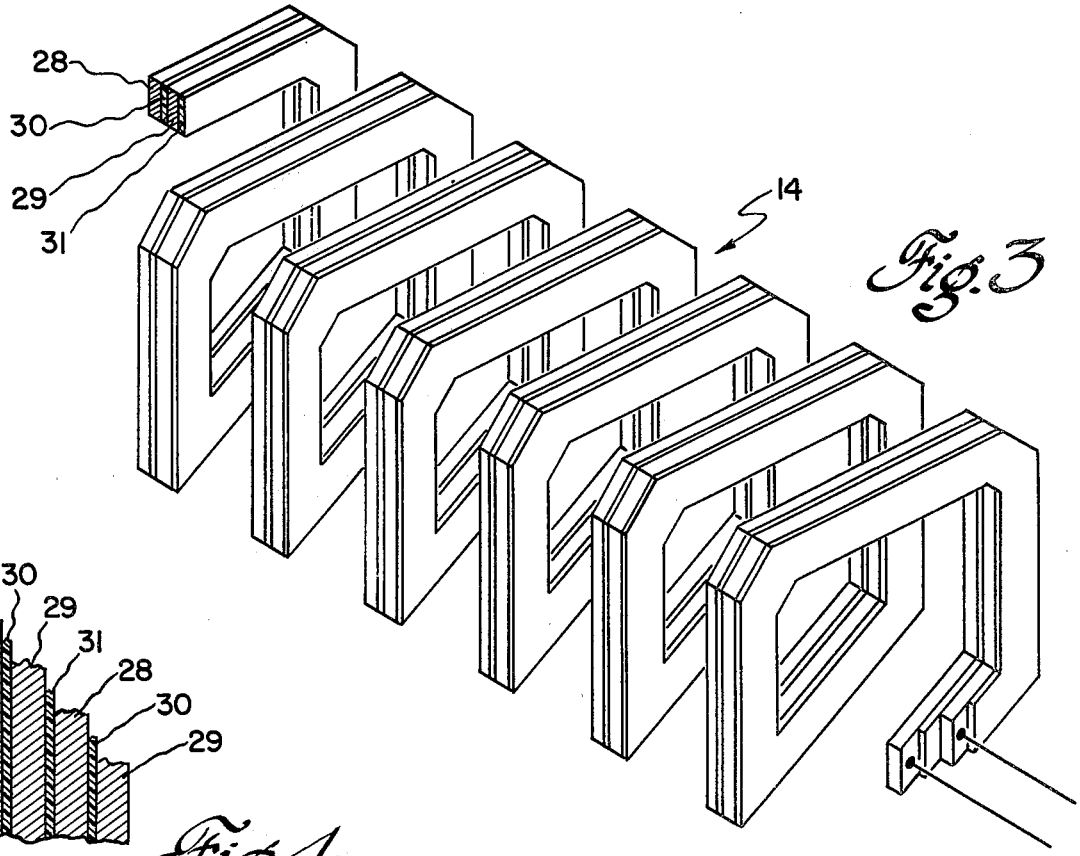
FIGS. 3 and 4 are a partial expanded view and a fragmentary cross section of the case in FIG. 1 to depict its configuration as a power factor capacitor.
Figure 4:
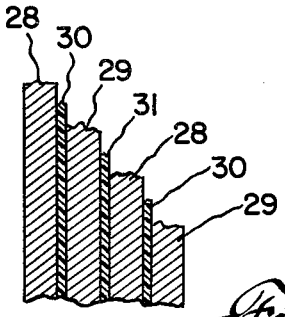

FIG. 3 shows to expanded scale a few turns of the bifilar, edge-wound and formed amorphous ribbon outer yoke and case 14. This laminated core section is made of a pair of parallel or superimposed magnetic amorphous metal strips 28 and 29 of relatively long length that alternate with insulating layers 30 and 31 and are wound in the nature of a squared-off helix. Viewed as a capacitor, the structure can be called a dry parallel-plate capacitor and connections are made to the ends of amorphous strips 28 and 29. When the core is assembled and successive turns are contacting as in FIG. 4, each strip is capacitively coupled to the other strip on the other side and the total capacitance is proportional to the total interlaminar area. The ribbon core material in its dual function as power factor capacitor 21 is conductively or electrically connected in series circuit relationship with secondary coil 16. Calculations prove that the total capacitance of outer yoke 14 is sufficient to provide good power factor in such a ballast.

The amorphous metal magnetic alloy needed for this application has a high ratio of remanent-to-saturation magnetization, i.e., $B_r/B_s$ is 80 percent or greater, where $B_r$ is the remanent induction and $B_s$ is the saturation or maximum induction. A core material of this type has a relatively square hysteresis loop; one such alloy presently known is $Fe_{82}B_{15}Si_3$, for which $B_r/B_s$ is about 90 percent. The dielectric may be a coating of varnish with the proper dielectric constant, a film of plastic or other suitable material. The magnetic properties of the amorphous metal alloy are improved by annealing the outer yoke after fabrication at temperatures of 300°–340° C. as taught generally in U.S. Pat. No. 4,116,728 to Becker et al. Insulating materials compatible with this annealing step are polyimide varnish (a DuPont product) and Kapton® plastic tape. One way of fabricating the outer yoke and case is to coat one surface of $Fe_{82}B_{15}Si_3$ alloy ribbon with varnish, and then take two such coated ribbons and wind them around a form two-in-hand.

Figure 5:
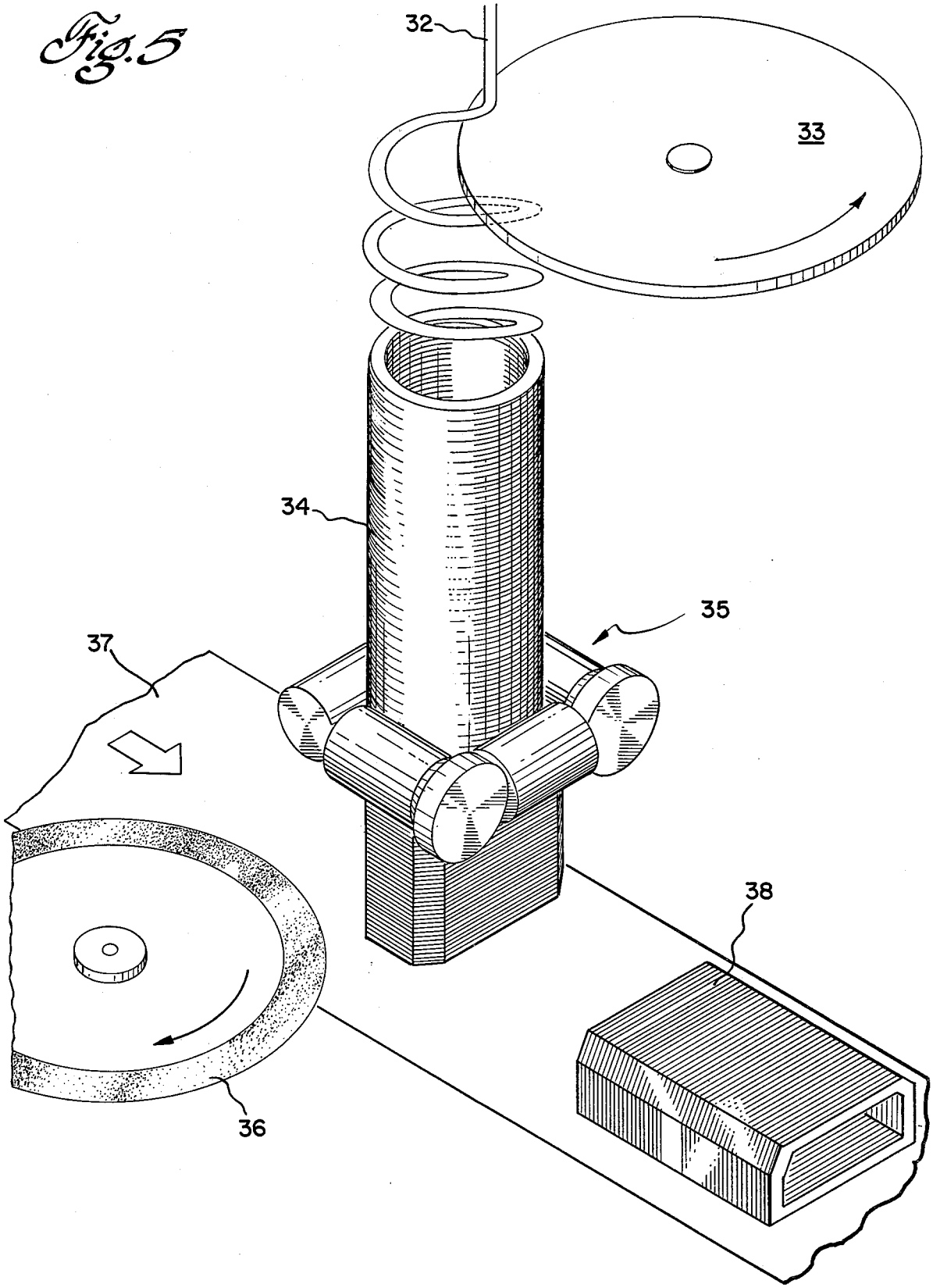
FIG. 5 is a sketch of one method for making the amorphous metal case.

Another method for fabricating amorphous metal case 14 is diagrammed in FIG. 5. Molten alloy 32 is splatted onto the surface of a rapidly rotating chill disk 33, is quenched at a high cooling rate in the order of $10^5$–$10^8$°C./sec to prevent formation of crystal structure, and is spun off in naturally curled ribbon form similar to the Skinky® spring toy. This tight, edge-wound helix 34 is profile formed such as over a progressive mandrel (not shown) by four external rollers 35 to conform to the desired outer profile of a ballast can. The helical core massaged into a more rectangular cross section is cut off to size by abrasive wheel 36 and drops onto conveyor belt 37. The resulting outer yoke component (two are needed with associated dielectric) is shown at 38.

Referring to FIG. 6, inner core 11 which has a dual function as starting capacitor 22 is bifilar wound into accordion pleats from amorphous metal strip coated with an appropriate dielectric material. The pair of parallel amorphous metal strips are indicated at 39 and 40 and the alternated insulating layers at 41, 42, and 43. External dielectric coatings on both sides of the strips are needed to prevent metal-to-metal contact at the folds of the accordion-pleated structure. Capacitor connections are illustrated and are made to the ends of amorphous strips 39 and 40. The dry parallel-plate capacitor provided in this manner is connected in series circuit relationship with the power factor capacitor embodied within outer yoke 14, and with secondary coil 16. The core cross section is reduced over a specified length by cutting a groove 44 with a grinding wheel. This cutaway is located under the secondary coil and causes core saturation to shape the lamp current waveform, as explained in greater detail in application Ser. No. 966,855. Additional grooves 45 may be cut into the inner core to secure the proper magnetic flux nonlinearities.

Figure 7:
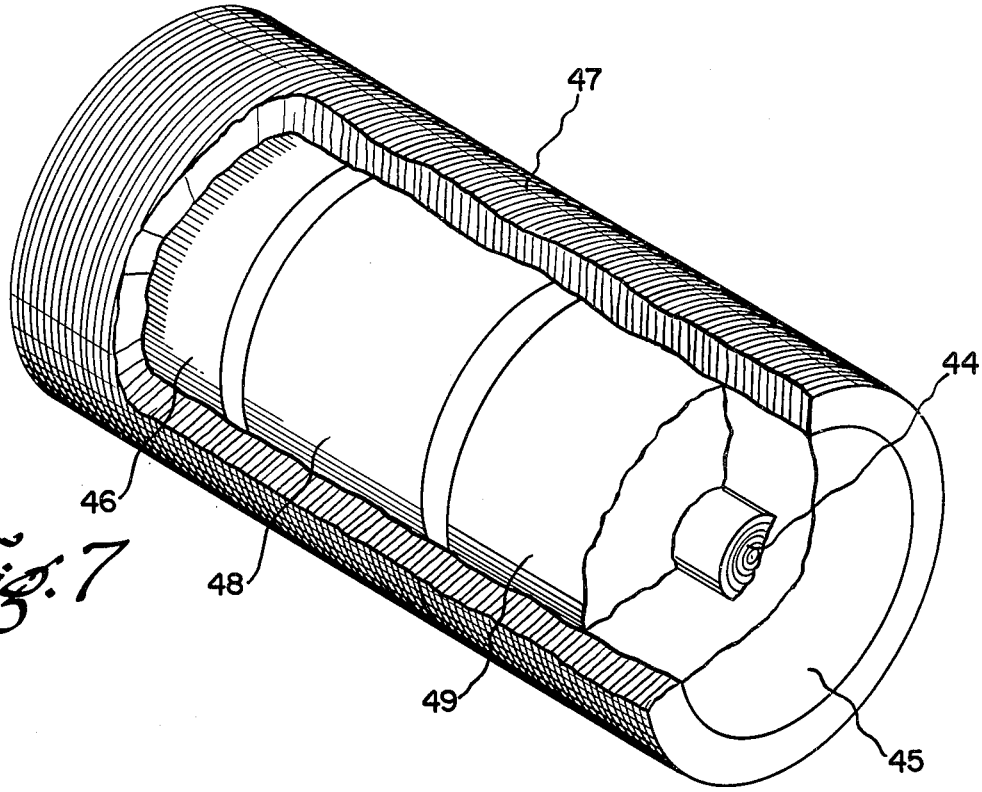
FIG. 7 is a modification of FIG. 1 having a round rather than a rectangular geometry.
Figure 8:
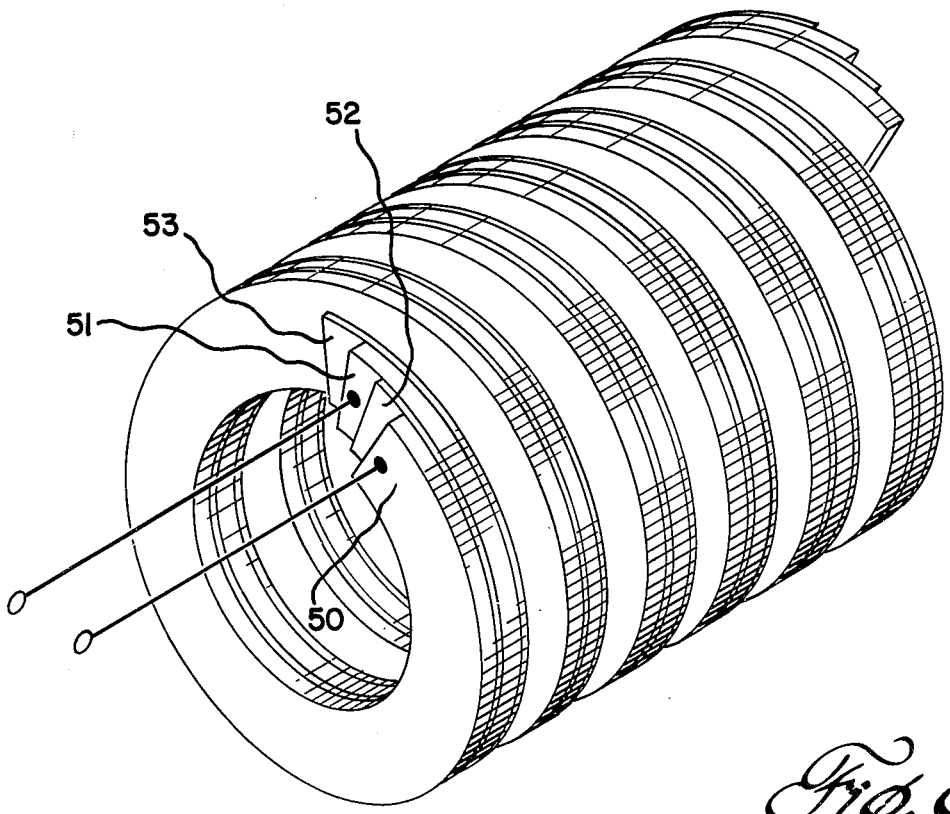
FIG. 8 is a partial expanded view of the two-in-hand helically wound case in FIG. 7.

The lamp ballast assembly with integral capacitors of FIG. 1 may be built with a round geometry as depicted in FIGS. 7–9. Inner core 44 is a long cylindrical rod made of spirally wound bifilar strips coated with an insulator. Circular end yokes 45 and 46 are cast onto the ends of the inner core and are comprised of compressed amorphous metal flake in a binder. Outer yoke 47 of the magnetic core is helically wound two-in-hand with alternate insulating layers as illustrated to expanded scale in FIG. 8. The parallel edge-mounted amorphous metal helices are indicated at 50 and 51 and the dielectric coatings or layers at 52 and 53. The helical outer yoke as before serves as the ballast case and is electrically connected in series with secondary coil 48 to be the power factor capacitor. This coil and primary coil 49 have a round shape.

The construction of spirally wound inner core 44 is given in greater detail in FIG. 9. A first amorphous metal ribbon 54 coated with dielectric 55 and a second ribbon 56 coated with dielectric 57 are bifilar wound like a spool of tape, and the resulting capacitor structure has a cross section similar to that in FIG. 4. Capacitor connections are made to the exposed ends of ribbons 54 and 56. The starting capacitor of the ballast assembly is relatively small (typically 0.05 microfarads) and a reasonable alternative is to use a discrete capacitor which can be located in available space within the magnetic structure. In this case, inner core 44 (the same is true of inner core 11) can also be fabricated of compressed amorphous flake or chips, with or without a binder, as taught in copending application Ser. No. 954,197 filed on Oct. 24, 1978, P. G. Frischmann, "Molded Amorphous Metal Electrical Magnetic Components", assigned to the same assignee as this invention. Another way of manufacturing the inner core is to twist together long narrow ribbons of amorphous metal much as cable is made.

Another embodiment of the invention in FIG. 10 has a rectangular geometry with planar end and outer yokes assembled together as a four-walled structure to provide a closed magnetic circuit and return paths for magnetic flux. The four-walled structure boxes in the ballast assembly and is configured to be the power factor capacitor. The inner core can be identical to inner core 11 in FIG. 1, as are coils 15 and 16. Planar end yokes 58 and 59 and outer yokes 60 and 61 are all bifilar wound or folded into accordion pleats as in FIG. 4. Considering that each wall member is a capacitor, the four capacitor structures are joined by welding together adjacent strip ends at three corners and attaching electrical leads at one corner. Opposite ends of the inner core are welded to the bared surfaces of end yokes 58 and 59 or are inserted into holes in the end yokes and welded in place.

A different configuration of the end and outer yokes is realized by coating rectangular amorphous metal ribbon with dielectric material, and stacking the coated ribbons to achieve the desired wall thickness. One set of alternate ribbons are joined at one side of the yoke, and the interleaved set of alternate ribbons are joined at the other side of the yoke. This is also a dry parallel-plate capacitor, and the four capacitors are connected in series or parallel to achieve the desired capacitance.

The lamp ballast with integral capacitor in FIG. 11 has a toroidal core 62 on which are wound distributed primary and secondary windings 63 and 64. The magnetic core is a two-in-hand wound helix similar to outer yoke 47 shown in FIGS. 7 and 8. The helical core is also a capacitor for power factor correction and starting and is electrically connected in series circuit relationship with the secondary coil. The core has one or more grooves 65 cut into its inner surface under the secondary coil to secure core saturation and the proper flux nonlinearities. Saturation of the core over a specified length causes a pulse condition which initiates starting of the lamp, causes a voltage regulation condition which filters out transistory voltage waves in the line, and shapes the current waveform for optimum lamp efficiency. A modification of this configuration or a previous embodiment is that the ballast may have only one coil which is in series with the lamp, and the integral capacitor is placed across the line. Ballast or lighting reactors of this type are common in Europe for 220 volt circuits.

The ballast and capacitor may also be made up in modules which are then assembled together, and the modular capacitors are connected in series or parallel to obtain the desired capacitance. The forms of the invention depicted in FIGS. 1, 7, and 10 are all suitable for modular fabrication; different loads are accommodated by adding more or less modules. Toroidal modules are compatible with both core and capacitor designs and are especially useful for Lucalox® lamp ballasts.

Amorphous metal lamp ballasts have low core losses and are efficient, and have the potential of being economical to manufacture considering that there is no scrap (laminations punched from steel strip generate considerable scrap). Inclusion of the required capacitor or capacitors in the core assembly is a significant step in achieving lower cost magnetic lamp ballast with a higher power efficiency.

While the invention has been particularly shown and described with reference to several preferred embodiments thereof, it will be understood by those skilled in the art that the foregoing and other changes in form and details may be made therein without departing from the spirit and scope of the invention.

The invention claimed is:

1. A magnetic lamp ballast comprising: a laminated magnetic core at least part of which has a dual function as a capacitor and is comprised of magnetic amorphous metal ribbon and associated dielectric layers that are assembled to be a continuous magnetic structure with alternating laminations and dielectric, at least one coil mounted on and magnetically coupled with said core, said coil being electrically connected to the amorphous metal ribbon separated by dielectric layers which functions as said capacitor in circuit relationship with said soil.

2. The ballast of claim 1 wherein said amorphous metal ribbon is made of a magnetic alloy with a $B_r/B_s$ ratio exceeding 80 percent.

3. A magnetic lamp ballast with integral power factor and starting capacitors comprising: a magnetic structure having an inner core and end and outer yokes providing a closed magnetic circuit, primary and secondary coils assembled on and magnetically coupled with said inner core, said outer yoke enclosing said coil and being bifilar wound from a first pair of magnetic amorphous metal strips separated by alternating insulating layers which are electrically connected in circuit relationship with said secondary coil to be said power factor capacitor, said inner core also being bifilar wound from a second pair of amorphous metal strips separated by alternating insulating layers which are electrically connected in circuit relationship with said first pair of strips and secondary coil to be said starting capacitor.

4. The ballast of claim 3 wherein said end yokes are made of compressed amorphous metal flake.

5. The ballast of claim 3 wherein said inner core has at least one groove located under the secondary coil to cause core saturation and shape the lamp current waveform.

6. A magnetic lamp ballast comprising: a core structure providing a closed magnetic circuit and having an elongated inner core, a pair of end yokes secured to either end of said inner core, and an outer yoke which also serves as a case and is mounted on said end yokes, primary and secondary coils assembled on and magnetically coupled with said inner core, said outer yoke having another function as a power factor capacitor and comprised of edge-mounted turns of a first pair of parallel magnetic amorphous metal strips separated by alternating insulating layers, said secondary coil being electrically connected in series circuit relationship with said pair of amorphous metal strips separated by insulating layers which function as said power factor capacitor.

7. The ballast of claim 6 wherein said outer yoke has a generally rectangular configuration and said end yokes are made of compressed amorphous metal flake.

8. The ballast of claim 6 or claim 7 wherein said inner core has a dual function as a starting capacitor and is comprised of accordion-pleated folds of a second pair of parallel magnetic amorphous metal strips separated by alternating insulating layers which are electrically connected in series circuit relationship with said first pair of amorphous metal strips separated by insulating layers and are said starting capacitor in series with the power factor capacitor.

9. The ballast of claim 6 wherein said outer yoke has a cylindrical configuration and said end yokes are made of compressed amorphous metal flake.

10. The ballast of claim 6 or claim 9 wherein said inner core has a dual function as a starting capacitor and is comprised of a spirally wound second pair of parallel amorphous metal strips separated by alternating insulating layers which are electrically connected in series circuit relationship with said first pair of amorphous metal strips separated by insulating layers and are said starting capacitor in series with the power factor capacitor.

11. A magnetic lamp ballast with an integral capacitor comprising: a core structure providing a closed magnetic circuit and having an elongated inner core, a pair of planar end yokes secured to either end of said inner core, and a pair of planar outer yokes secured between said end yokes, primary and secondary coils assembled on and magnetically coupled with said inner core, said end and outer yokes each comprised of accordion-pleated folds of a pair of parallel magnetic amorphous metal strips separated by alternating insulating layers, the pair of pleated amorphous metal strips in said end and outer yokes further being electrically connected together and electrically connected in circuit relationship with said secondary coil to be said capacitor.

12. The ballast of claim 11 wherein said inner core also has a dual function as a second capacitor and is comprised of accordion-pleated folds of another pair of parallel magnetic amorphous metal strips separated by alternating insulating layers which are electrically connected in circuit relationship with said secondary coil and first-mentioned capacitor.

13. A magnetic lamp ballast with an integral capacitor comprising: a toroidal core structure on which primary and secondary coils are assembled and magnetically coupled therewith, said core structure being constructed of multiple insulated turns of a pair of magnetic amorphous metal strips of relatively long length separated by alternating insulating layers, said secondary coil being electrically connected in circuit relationship with said pair of amorphous metal strips separated by insulating layers which function as said capacitor.

14. The ballast of claim 13 wherein said toroidal core structure has a groove located under the secondary coil to cause core saturation and shape the lamp current waveform.

* * * * *